US007231681B2

(12) United States Patent
Kasatshko et al.

(10) Patent No.: US 7,231,681 B2
(45) **Date of Patent: *Jun. 19, 2007**

(54) MULTIPLE POSITION AIR MATTRESS SYSTEM

(75) Inventors: Victor M. Kasatshko, 1155 Dartford Dr., Tarpon Springs, FL (US) 34688; Nicholas J. Webb, Redding, CA (US)

(73) Assignee: Victor M. Kasatshko, Tarpon Springs, FL (US)

( * ) Notice: Subject to any disclaimer, the term of this patent is extended or adjusted under 35 U.S.C. 154(b) by 139 days.

This patent is subject to a terminal disclaimer.

(21) Appl. No.: 11/079,939

(22) Filed: Mar. 14, 2005

(65) Prior Publication Data

US 2005/0155154 A1 Jul. 21, 2005

Related U.S. Application Data

(63) Continuation-in-part of application No. 10/744,874, filed on Dec. 23, 2003, now Pat. No. 6,886,204, which is a continuation-in-part of application No. 10/350,587, filed on Jan. 24, 2003, now abandoned.

(51) Int. Cl.
*A47C 20/04* (2006.01)

(52) U.S. Cl. ..... 5/722; 5/733; 5/633; 5/710

(58) Field of Classification Search ..... 5/731–734, 5/710, 722, 615, 632–634; 297/452.41
See application file for complete search history.

(56) References Cited

U.S. PATENT DOCUMENTS 1,976,320 A 10/1934 Austin
2,623,574 A 12/1952 Damsch
3,029,109 A 4/1962 Nail
3,128,480 A 4/1964 Lineback
3,286,285 A 11/1966 Harvey, Jr.
3,308,489 A 3/1967 Winkler
3,572,836 A 3/1971 Khanh
3,606,623 A 9/1971 Aymar (Continued)

OTHER PUBLICATIONS

Advertisement for UK Airbeds, Airmats, Air Mattresses, Lilos For traveling, camping, pool, beach and seaside.

(Continued)

*Primary Examiner*—Michael Trettel
(74) *Attorney, Agent, or Firm*—Gordon & Jacobson, PC

(57) ABSTRACT

A multiple position air mattress system for achieving various support positions includes a first mattress, a second mattress, and a bellows unit attached to the second mattress. The bellows unit is extendable for either elevating the second mattress or providing a support for an individual. A pump unit is adapted to be fluidly connected to and for providing pressurized air to the first mattress, the second mattress and the bellows unit. The multiple position air mattress can assume a prone bed position with the mattresses longitudinally adjacent each other and the bellows unit deflated, a recessed lounge position with the mattresses longitudinally adjacent each other and the bellows unit inflated and atop the second mattress, an adjustable lounge position with the mattresses longitudinally adjacent each other and the bellows unit inflated under the second mattress, and a chair position with the first mattress under the second mattress, and the mattresses and bellows unit inflated.

9 Claims, 10 Drawing Sheets

U.S. PATENT DOCUMENTS

| | | | |
|---|---|---|---|
| 3,740,095 | A | 6/1973 | Nall |
| 3,740,774 | A | 6/1973 | Powell |
| 3,742,526 | A | 7/1973 | Lillard |
| 3,751,739 | A | 8/1973 | Assmann |
| 3,890,658 | A | 6/1975 | Petersilie |
| 3,902,759 | A | 9/1975 | Monteforte et al. |
| 3,959,835 | A | 6/1976 | Nos |
| 3,978,530 | A | 9/1976 | Amarantos |
| 4,153,958 | A | 5/1979 | Paulik |
| 4,173,045 | A | 11/1979 | Osborn |
| 4,175,297 | A | 11/1979 | Robbins et al. |
| 4,207,633 | A | 6/1980 | Smith et al. |
| 4,255,824 | A | 3/1981 | Pertchik |
| 4,459,714 | A | 7/1984 | Lin |
| 4,518,203 | A | 5/1985 | White |
| 4,527,298 | A | 7/1985 | Moulton |
| 4,639,960 | A | 2/1987 | Quillen et al. |
| 4,685,163 | A | 8/1987 | Quillen et al. |
| 4,829,614 | A | 5/1989 | Harper |
| 4,836,605 | A | 6/1989 | Greenwood et al. |
| 4,839,932 | A | 6/1989 | Williamson |
| 4,873,731 | A | 10/1989 | Williamson |
| 4,890,344 | A | 1/1990 | Walker |
| 4,905,332 | A | 3/1990 | Wang |
| 4,932,721 | A | 6/1990 | Anthony |
| 4,941,221 | A | 7/1990 | Kanzler |
| 4,991,244 | A | 2/1991 | Walker |
| 5,058,225 | A | 10/1991 | Annand |
| 5,170,522 | A | 12/1992 | Walker |
| 5,267,363 | A | 12/1993 | Chafee |
| 5,311,625 | A | 5/1994 | Barker et al. |
| 5,335,968 | A | 8/1994 | Sheridan et al. |
| 5,345,630 | A | 9/1994 | Healy |
| 5,367,726 | A | 11/1994 | Chafee |
| 5,439,405 | A | 8/1995 | Storey et al. |
| 5,506,012 | A | 4/1996 | Wright et al. |
| 5,516,188 | A | 5/1996 | Bruhnke et al. |
| 5,560,056 | A | 10/1996 | Tai |
| 5,566,409 | A | 10/1996 | Klearman |
| 5,577,278 | A | 11/1996 | Barker et al. |
| 5,689,845 | A | 11/1997 | Sobieralski |
| 5,699,569 | A | 12/1997 | Schwarz-Zohrer |
| 5,787,531 | A | 8/1998 | Pepe |
| 5,806,115 | A | 9/1998 | Brown |
| 5,809,597 | A | 9/1998 | Shaw |
| D406,870 | S | 3/1999 | Bauman |
| 5,881,407 | A | 3/1999 | Chu Pt |
| 5,963,997 | A | 10/1999 | Hagopian |
| 5,966,762 | A | 10/1999 | Wu |
| 5,970,545 | A | 10/1999 | Garman et al. |
| 6,012,186 | A | 1/2000 | Soltani et al. |
| 6,042,186 | A | 3/2000 | Kojic et al. |
| 6,058,538 | A | 5/2000 | Chapman et al. |
| D434,243 | S | 11/2000 | Casto et al. |
| 6,224,444 | B1 | 5/2001 | Klimenko |
| 6,397,419 | B1 | 6/2002 | Mechache |
| 6,499,166 | B1 | 12/2002 | Jones |
| 6,739,005 | B2 | 5/2004 | Davis |
| 6,848,137 | B1 | 2/2005 | Barnes |
| 6,886,204 | B2 | 5/2005 | Kasatshko et al. |
| 6,981,287 | B1 | 1/2006 | Chen |
| 2005/0099054 | A1 | 5/2005 | McCarthy |

OTHER PUBLICATIONS

"The Sleep Number Bed by Select Comfort™", available at http://selectcomfort.com/beds/index.cfm?proc=1&cmref=homeside.

MULTIPLE POSITION AIR MATTRESS SYSTEM

CROSS REFERENCE TO RELATED APPLICATIONS

The present application is a continuation-in-part of U.S. patent application Ser. No. 10/744,874, filed Dec. 23, 2003, now U.S. Pat. No. 6,886,204, which is a continuation-in-part of U.S. patent application Ser. No. 10/350,587, filed Jan. 24, 2003, now abandoned, both of which are herein incorporated by reference in their entireties.

BACKGROUND OF THE INVENTION

1. Field of the Invention

The present invention relates generally to air mattresses and more specifically it relates to a multiple position air mattress system for achieving various support positions.

2. Description of the Related Art

Air mattresses have been in use for years. A conventional air mattress is comprised of a rectangular flat structure that is inflatable forming a bed-like structure. Conventional air mattresses may have pumps built into them or may be inflated from an external air source. Conventional air mattresses are not capable of being positioned in more than a prone bed position. The present invention overcomes the inherent limitations contained within conventional air mattresses.

BRIEF SUMMARY OF THE INVENTION

In view of the foregoing disadvantages inherent in the known types of air mattresses now present in the prior art, the present invention provides a new multiple position air mattress system construction which can be utilized for achieving various support positions and support functions.

The general purpose of the present invention, which will be described subsequently in greater detail, is to provide a new multiple position air mattress system that has many of the advantages of the air mattresses mentioned heretofore and many additional features that result in a new multiple position air mattress system.

Thus, a primary object of the present invention is to provide a multiple position air mattress system that will overcome the shortcomings of the prior art devices.

Another object is to provide a multiple position air mattress system for achieving various support positions.

A further object is to provide a multiple position air mattress system that may form into various positions such as but not limited to a chair, a recessed lounge, a prone bed and an adjustable lounge.

An additional object is to provide a multiple position air mattress system that is efficient and easy to utilize.

A further object is to provide a multiple position air mattress system that may be stored in a compact storage position.

In accord with these objects, the present invention generally comprises a first relatively larger mattress, a second relatively smaller mattress mechanically coupled to the first mattress, and a bellows unit attached to the second mattress. Each of the first mattress, second mattress, and bellows unit is preferably separately inflatable through separate valves. A pump unit is provided for supplying pressurized air to the first mattress, the second mattress and the bellows unit.

With the first relatively larger mattress, the second mattress and the bellows, the mattress system of the invention can be utilized to implement a chair, a recessed lounge, a prone bed and an adjustable lounge. In particular, with the bellows deflated, and the first and second mattresses longitudinally adjacent each other, the system implements a prone bed. With the bellows unit inflated and atop the second mattress, the system implements a recessed lounge. With the bellows unit inflated and below the second mattress, the system implements an adjustable lounge. With the bellows unit inflated above the second mattress, and the first mattress located under the second mattress, the system implements a chair.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invent ion in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Other objects and advantages of the present invention will become apparent to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

In the drawings, like reference characters designate the same or similar parts throughout the several views.

DETAILED DESCRIPTION OF THE INVENTION

A. Overview

Figure 1:
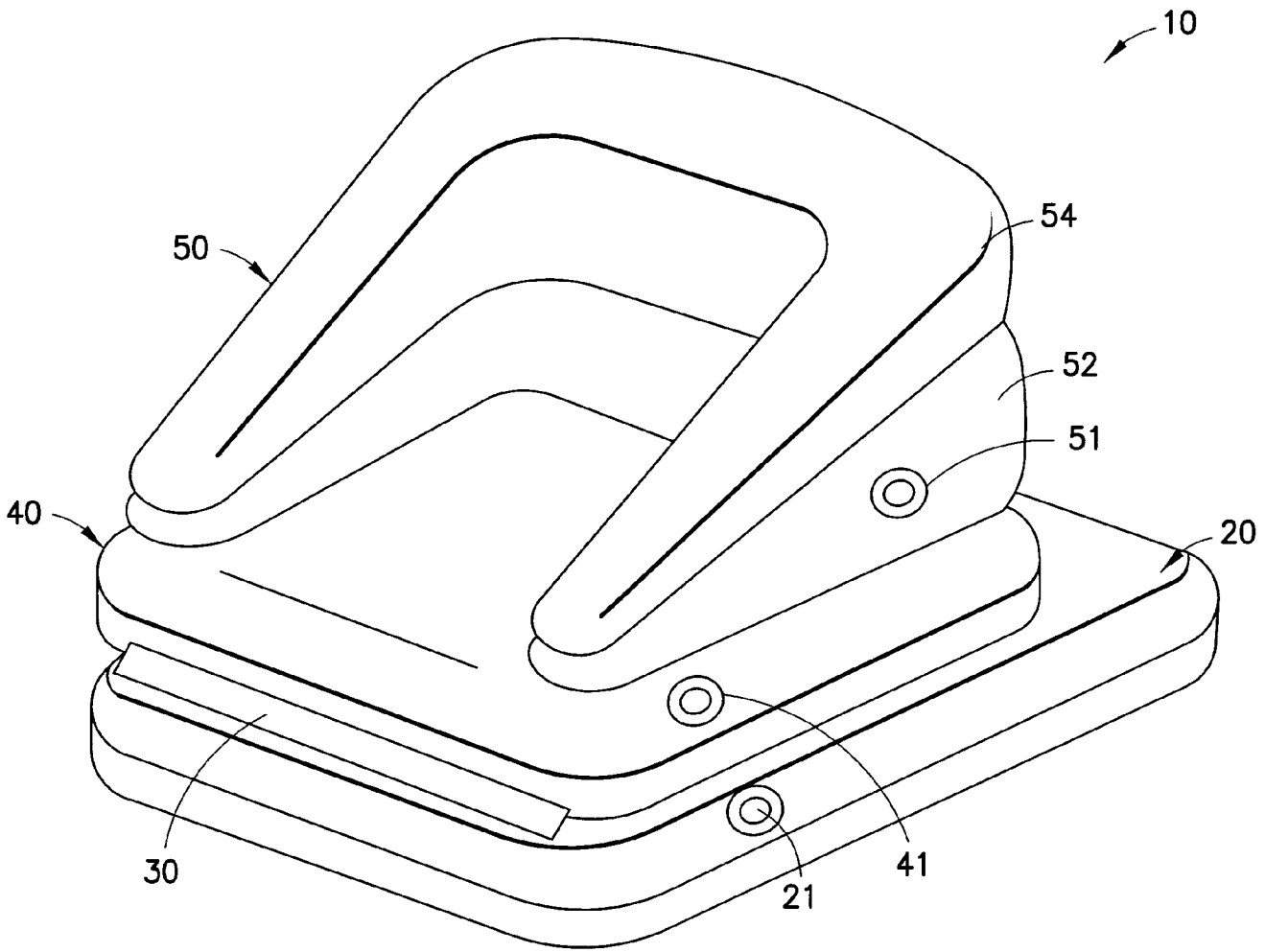
FIG. 1 is an upper perspective view of the present invention in the chair position.

Turning now descriptively to the drawings, in which similar reference characters denote similar elements throughout the several views, FIGS. 1 through 11 illustrate a multiple position air mattress system 10, which comprises a first mattress 20, a second mattress 40 connected to the first mattress 20 by a hinge member 30, and a bellows unit 50 attached to the second mattress 40. Each of the first mattress 20, the second mattress 40, and the bellows unit 50 is preferably provided with a respective air intake/outlet valve 21, 41, 51, for separately inflating or deflating that unit. A pump unit 60 is provided for providing pressurized air to the first mattress 20, the second mattress 40 and the bellows unit 50.

A. First Mattress

FIGS. 1 through 7 illustrate the first mattress 20. The first mattress 20 is inflatable via valve 21 and may be comprised of various inflatable structures and shapes. The first mattress 20 is preferably comprised of flocked PVC having a thickness of 0.55 mm, although it may be comprised of various materials capable of retaining pressurized air within. In addition, the first mattress may have an internal coil or other support structure such as a series of cylindrical or otherwise shaped columns (not shown) coupling the top and bottom surfaces of the mattress. The first mattress 20 may also be coated or covered with various types of materials. The first mattress 20 in the preferred embodiment is (when inflated) approximately forty-two inches long, thirty-nine inches wide, and nine inches high. The first mattress may further be provided with one or more slots or holes (not shown) on either side of the mattress so that the mattress may be coupled by a belt or other coupling means to a similar first mattress, when the mattress system is used as part of a king-sized bed arrangement.

B. Second Mattress

Figure 2:
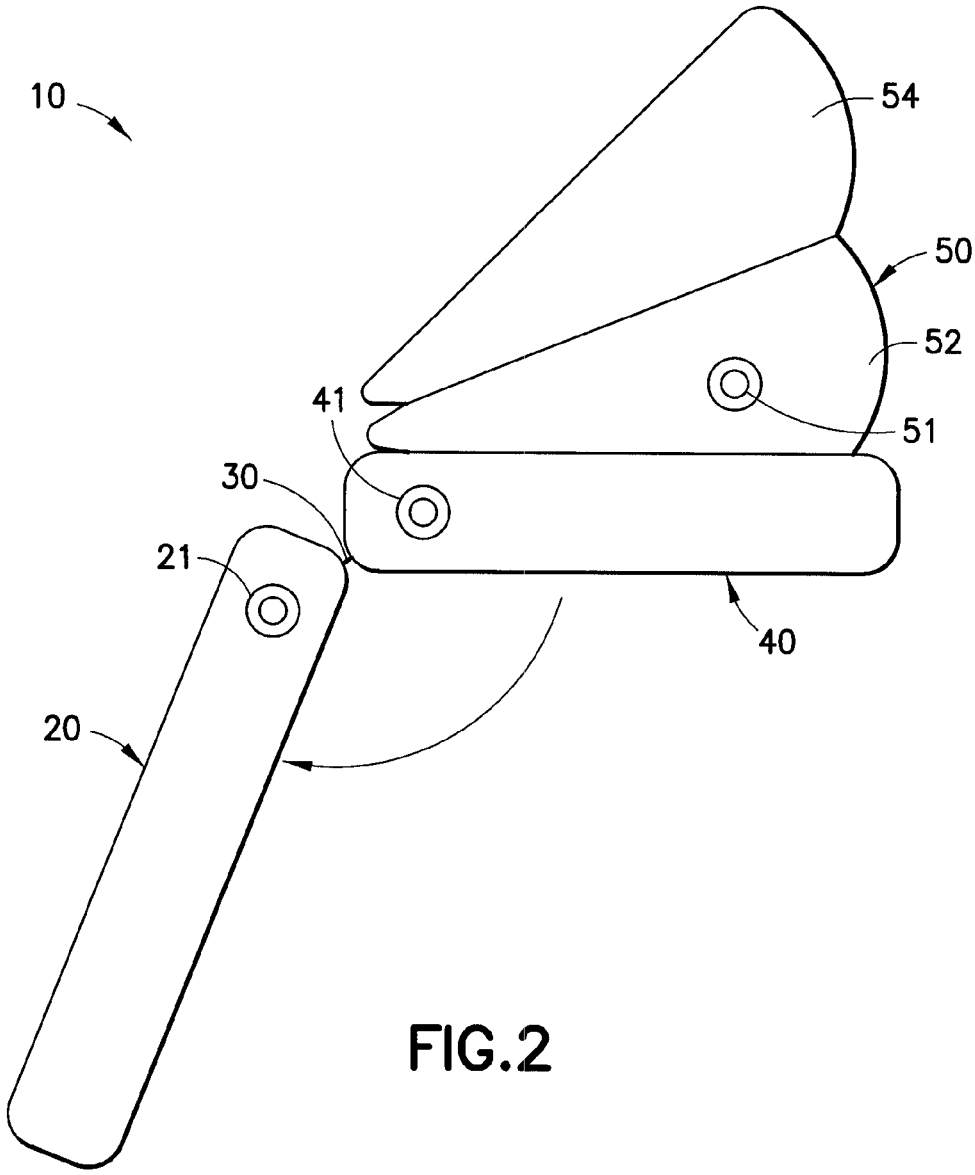
FIG. 2 is a side view of the present invention being converted from the chair position to the recessed lounge position.
Figure 3:
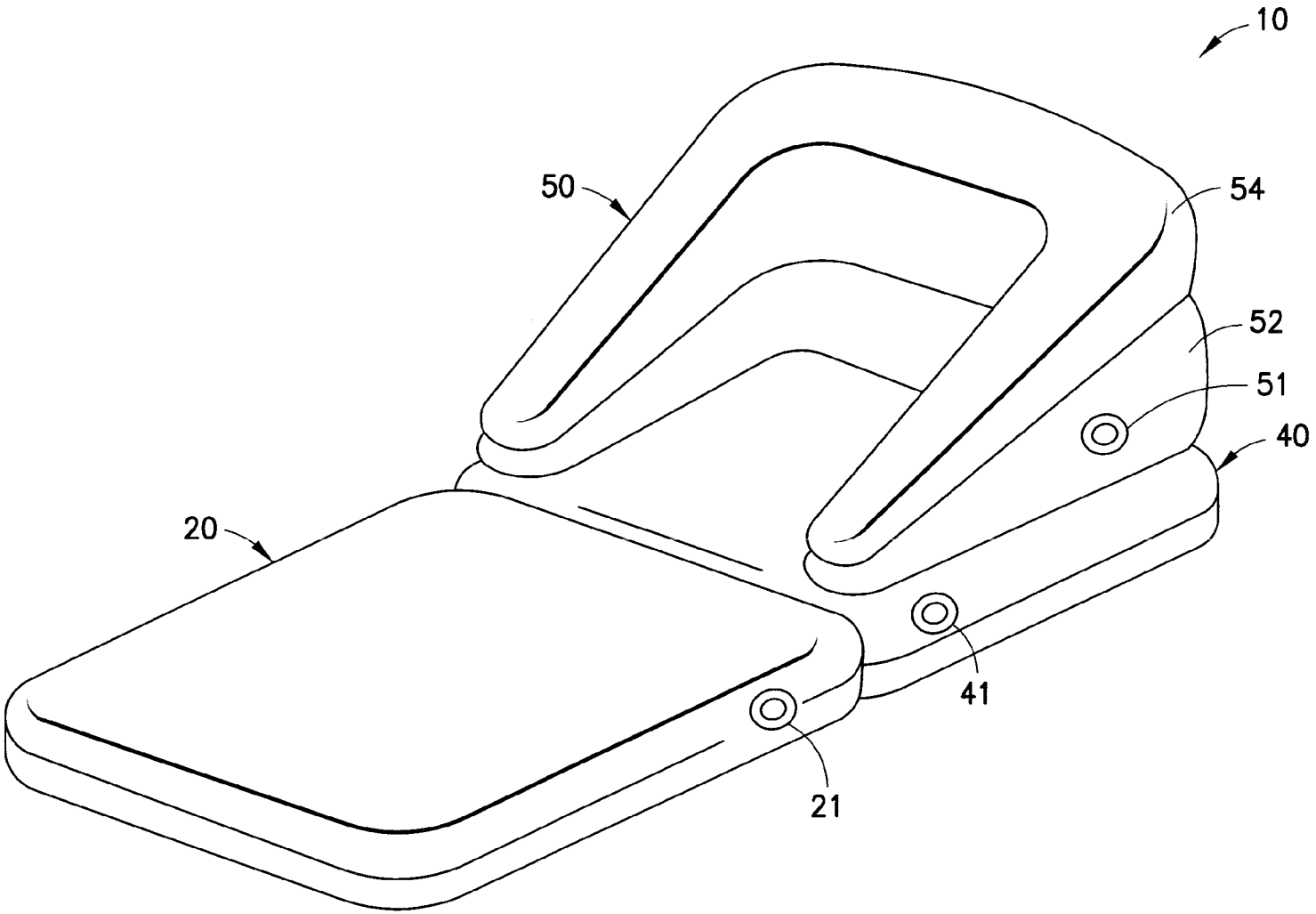
FIG. 3 is an upper perspective view of the present invention in the recessed lounge position.
Figure 4:
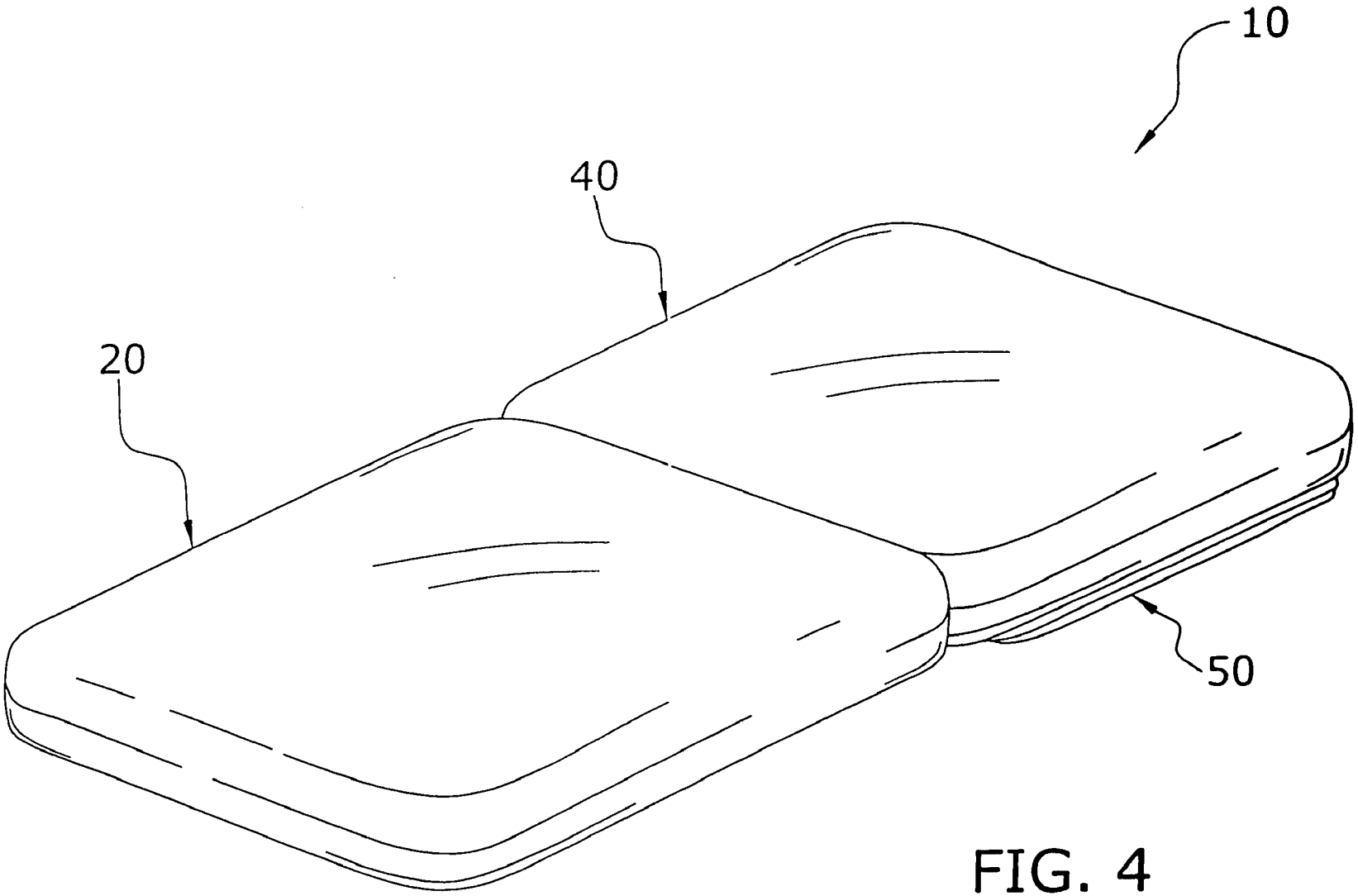
FIG. 4 is an upper perspective view of the present invention in the prone bed position.

FIGS. 1 through 7 illustrate the second mattress 40. The second mattress 40 is inflatable via valve 41 and may be comprised of various inflatable structures and shapes similar to the first mattress 20. The second mattress 40 is preferably comprised of flocked PVC having a thickness of 2 mils, although it may be comprised of various materials capable of retaining pressurized air within. In addition, the second mattress may have an internal coil or other support structure such as a series of cylindrical or otherwise shaped columns (not shown). The second mattress 40 may also be coated or covered with various types of materials. The second mattress 40 preferably has a structure similar to the first mattress 20 as best illustrated in FIG. 4 of the drawings, however the mattresses 20, 40 may have different structures. The second mattress 40 in the preferred embodiment (when inflated) is approximately thirty-three inches long, thirty-nine inches wide, and nine inches high.

The second mattress 40 is preferably pivotally connected (via hinge member 30) to the first mattress 20 as best illustrated in FIG. 2 of the drawings. The first mattress 20 and the second mattress 40 combined in a flat structure form a prone twin-sized bed structure as best illustrated in FIG. 4 of the drawings.

If desired, the second mattress 40 may be fluidly connected (via a tube—not shown) to the first mattress 20 to allow for simultaneous inflation and deflation. However, in the preferred embodiment of the invention, the second mattress 40 is not fluidly connected to the first mattress 20 and is inflated separately by the pressurized air source. This permits the first and second mattresses to be inflated to different pressure levels, which is desirable in providing desired support levels to different parts of the body. For example, because the human torso weighs considerably more than the legs, it may be desirable to inflate the second mattress to a higher degree than the first mattress, thereby providing more support to the torso.

C. Hinge Member

Figure 7:
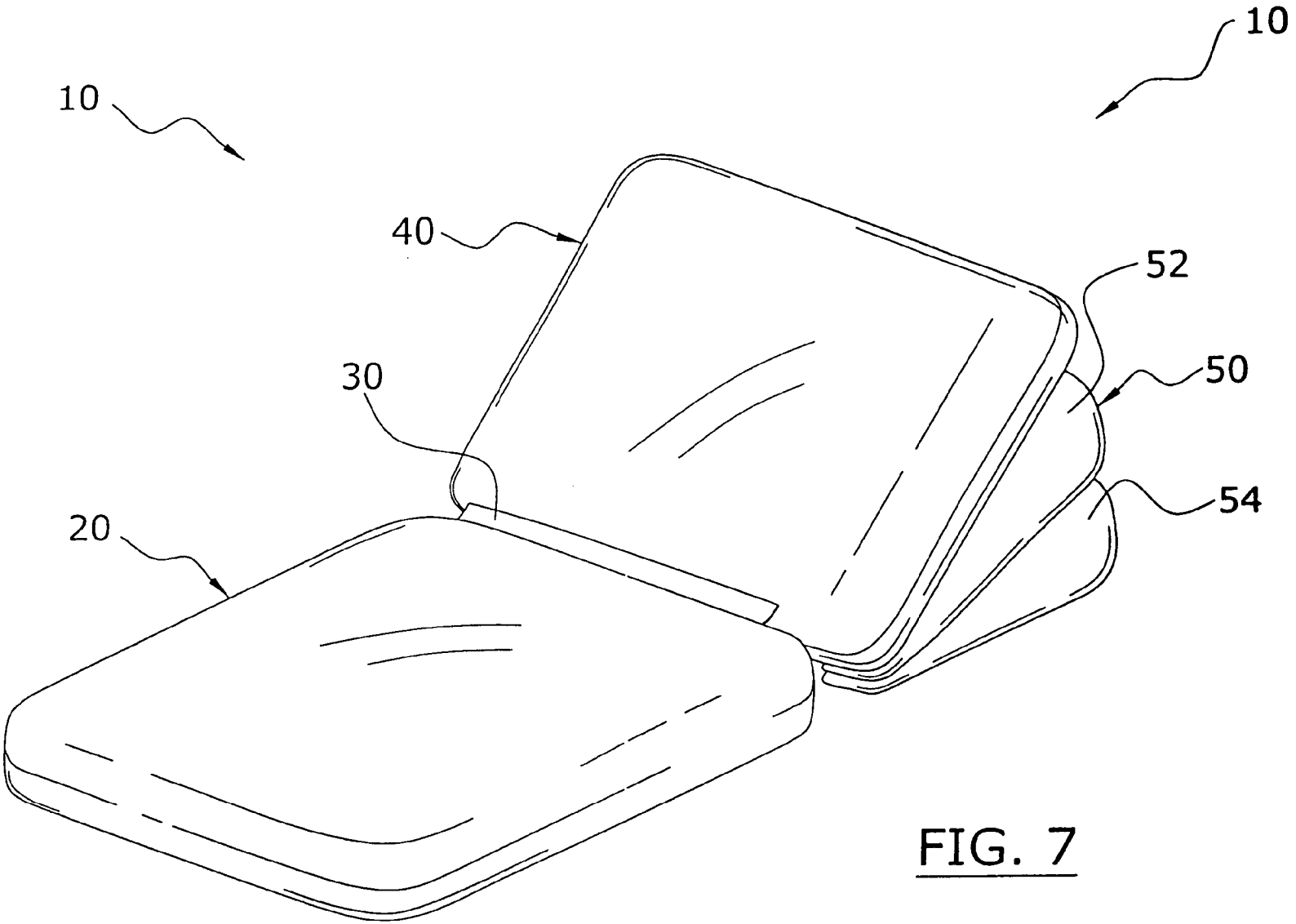
FIG. 7 is an upper perspective view of the present invention in the adjustable lounge position.

A hinge member 30 is preferably attached between the first mattress 20 and the second mattress 40 for pivotally sup porting the same as best illustrated in FIGS. 2 and 7 of the drawings. The hinge member 30 is preferably comprised of a flexible and flat piece of flocked PVC of 2 mils thickness. The hinge member 30 is preferably heat sealed to both the first mattress 20 and the second mattress 40, and is preferably located near the top surfaces (i.e., the surface opposite the surface of the bellows) of the first and second mattresses so that when the first and second mattresses are longitudinally arranged in a bed structure, the hinge member 30 fills the crack between the mattresses and provides a relatively continuous surface for the bed. Various other structures and configurations may be utilized to pivotally attached the first mattress 20 and the second mattress 40 together.

D. Bellows Unit

Figure 5:
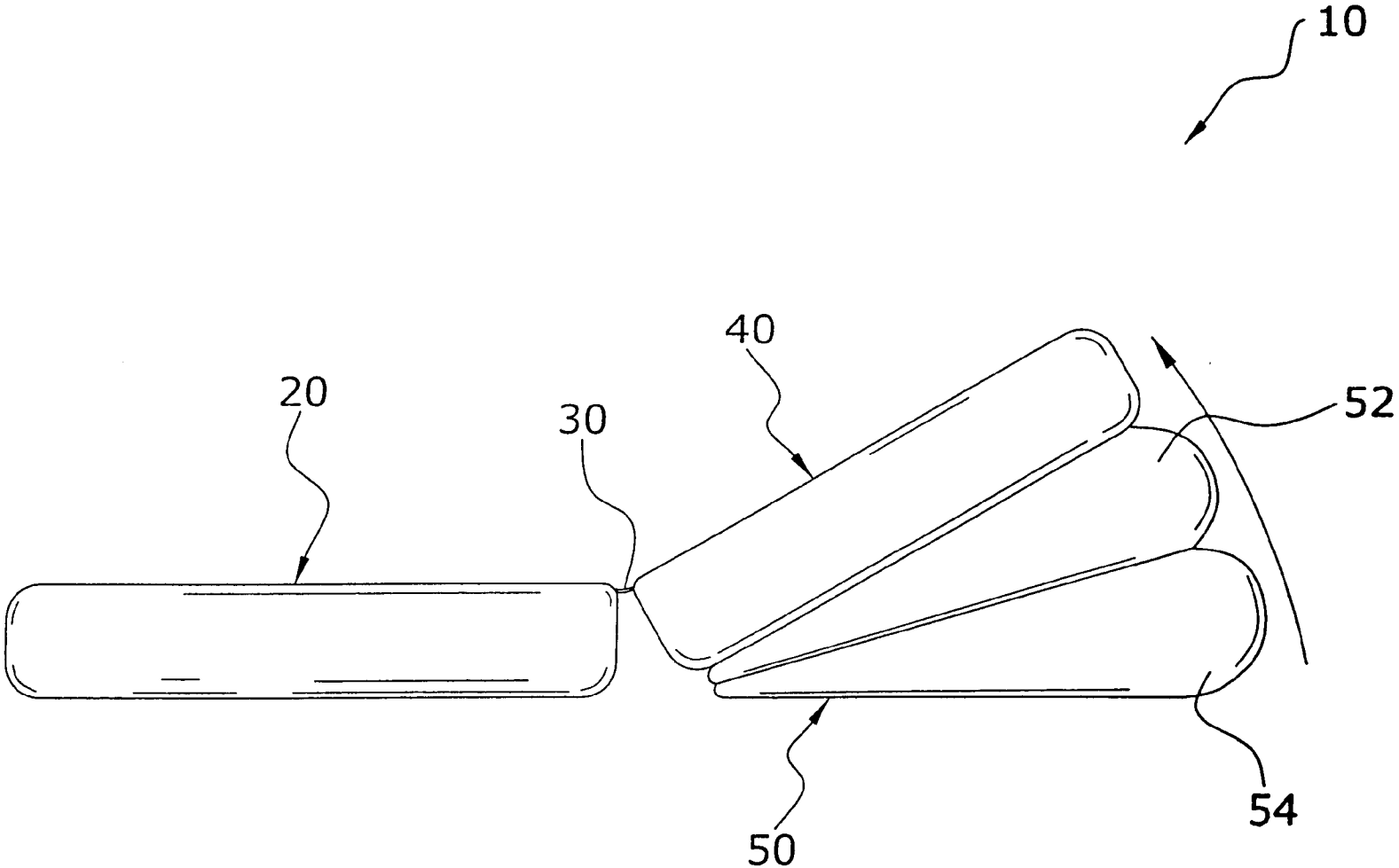
FIG. 5 is aside view of the present invention being converted from the prone bed position to the adjustable lounge position.
Figure 6:
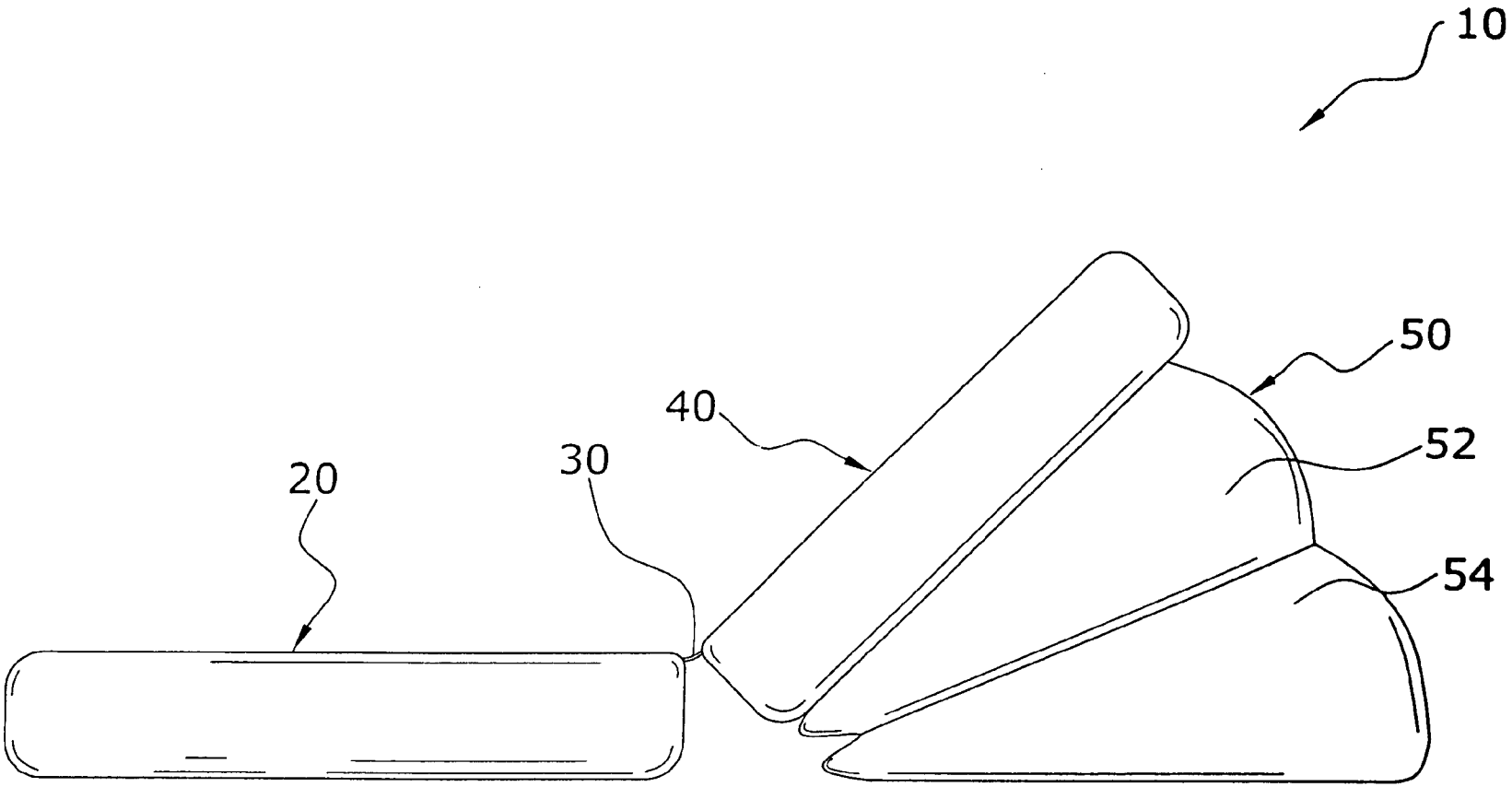
FIG. 6 is a side view of the present invention fully extended into the adjustable lounge position

The bellows unit 50 is attached to the second mattress 40 as illustrated in FIGS. 1 through 7 of the drawings. The bellows unit 50 is comprised of one or more bellows. FIGS. 5 and 6 best illustrate the bellows unit 50 having a first bellows 52 attached to a lower side of the second mattress 40 and a second bellows 54 attached to the first bellows 52. The second bellows 54 is preferably fluidly connected to the first bellows 52 to allow for simultaneous or conditioned pressurization of the first bellows 52 and the second bellows 54 (via one or more non-valved fluid paths or via valve 51) from the pressurized air source.

The bellows unit 50 preferably has a U-shaped structure which is highest at the back, and which tapers down in the front. The bellows unit, when completely inflated, is approximately twenty-three inches high at the back, and approximately ten inches high at the front of the arms. The arms are about five inches wide at the front (although they are preferably radiused with a radius of between 2 and 2.5 inches at their very front end), and they taper in width as they extend backwards such that the back of the bellows unit 50 is about twelve inches wide. From the tip of the arms to the back of the back, and from the outside of each of the arms, the U-shaped bellows unit 50 is approximately the same size as the second mattress 40; i.e., about thirty-nine inches across the arms and thirty-three inches from front to back.

When located under the second mattress and inflated, the first bellows 52 and the second bellows 54 elevate the second mattress 40 to a desired angle (preferably from zero degrees up to forty-five degrees) with respect to the first mattress 20 as best illustrated in FIGS. 5 and 6 of the drawings, thereby providing an adjustable lounge. When flipped over to be located above the second mattress, the bellows provide a recessed lounge structure as shown in FIG. 3 of the drawings.

In the preferred embodiment of the invention, the first and second bellows 51, 52 are fluidly coupled to one another via a number of non-valved flow paths. The bellows 51, 52 receive pressurized air from the pressurized air source via valve 51 such that they are inflated at substantially the same pressure. The extent of inflation of the bellows unit 50 is preferably controllable by the user. Alternatively, if desired, the first bellows 52 and second bellows 54 may be inflated to different pressures. This feature may be controlled by a valve (not shown) that fluidly couples the two bellows 52, 54, or by realizing the two bellows 52, 54 as two distinct air chambers that are pressurized independently from one another. Moreover, it is contemplated that the shape and structure of the bellows unit 50 may be changed as desired.

Figure 9:
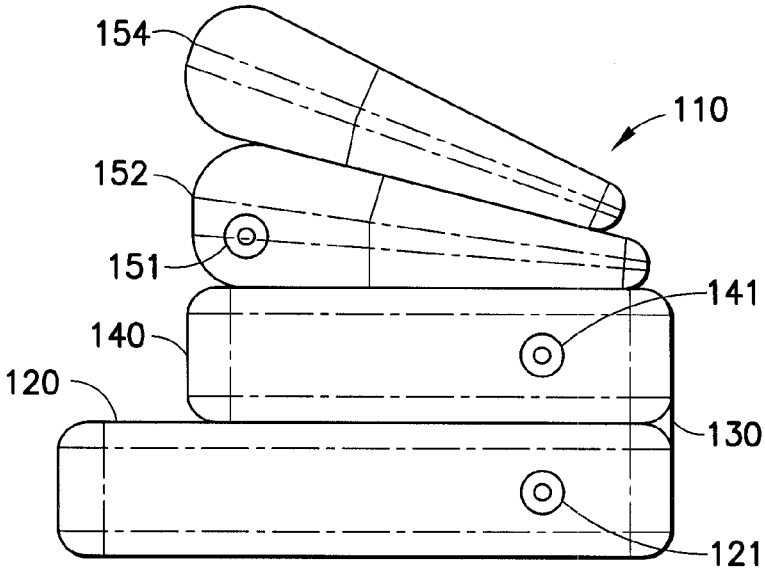
FIG. 9 is a side view of an alternative embodiment of the invention.

According to another embodiment of the invention shown in FIG. 9, a mattress system 110 is provided with a first mattress 120 having an inflation/deflation valve 121, a second mattress 140 with an inflation/deflation valve 141, a hinge 130, and a modified bellows unit 150 having first bellows 152, second bellows 154, and an inflation/deflation valve 151. In the alternative embodiment of FIG. 12, the second bellows 154 is seen to be slightly set back relative to the first bellows (i.e., the base of the second bellows 154 is pushed back relative to the top surface of the first bellows 152) such that the rear of the second mattress 140, the first bellows 152, and the second bellows 154 align substantially vertically. This arrangement provides more comfort in the seated position.

E. Valves

In the preferred embodiment of the invention, each of the mattresses and the bellows unit is provided with its own respective inflation/deflation valve 21, 41, 51. An additional valve (not shown) may be provided to inflate the second bellows 54 separately from the first bellows 54 if they are not fluidly connected.

F. Pump Unit

Figure 8:
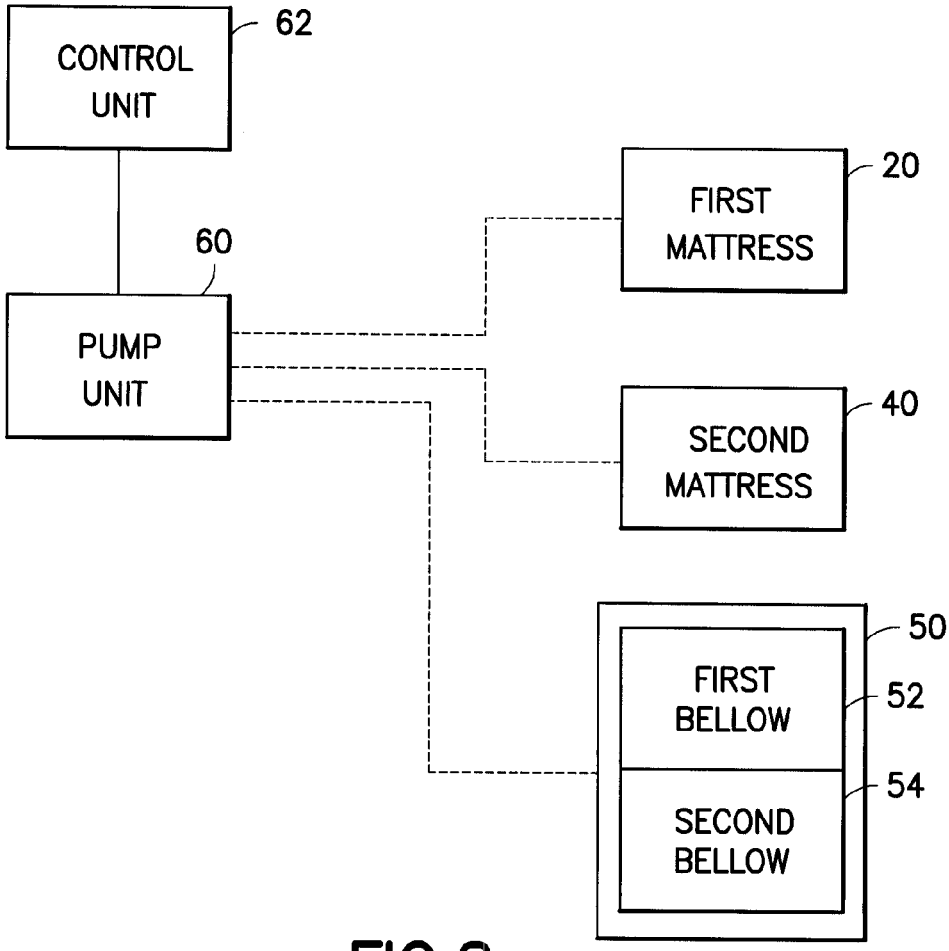
FIG. 8 is a block diagram illustrating the fluid connections of the air mattress system of the invention.

As shown in FIG. 8, in the preferred embodiment, a pump unit 60 is fluidly connected to the first mattress 20, the second mattress 40, and the bellows unit 50 to provide pressurized air thereto. The pump unit 60 may be comprised of any pump structure capable of providing pressurized air. The pump unit 60 may be external or internal oft he first mattress 20. The pump unit 60 may also be indirectly fluidly connected to the second mattress 40, and the bellows unit 50. Various other pressurized air sources may be utilized with respect to the present invention. A control unit 62 is preferably in communication with the pump unit for controlling the operation of the pump unit 60 and the airflow to the first mattress 20, the second mattress 40 and the bellows unit 50.

G. Operation

The present invention preferably has four main positions: a chair position, a recessed lounge position, a prone bed position and an adjustable lounge position. In use, the user first determines what position they desire. Regardless of the position desired, the user preferably inflates the first mattress 20 and the second mattress 40 as shown in FIG. 4 of the drawings. If the user desires a prone bed position, the user simply lays the first mattress 20 and the second mattress 40 up on a surface in a flat position as shown in FIG. 4 of the drawings with the hinge 30 preferably providing a relatively continuous structure and with the bellows unit 50 remaining deflated under the second mattress 40. As previously indicated, the first and second mattresses may be inflated to different pressures to provide desired support levels for different parts of the body.

If the user desires to have a chair posit ion, a recessed lounge position or an adjustable lounge position, the user then inflates the bellows unit 50 to a desired level. For example, if an adjustable lounge is desired the user may only inflate the first bellows 52 and not the second bellows 54 or alternatively only partially inflate the bellows unit 50 to achieve a desired height and angle for the second mattress 40 as illustrated in FIGS. 5 through 7 of the drawings. If a recessed lounge position is desired, the user preferably flips the first and second mattresses so that the bellows unit is atop the second mattress, and fully inflates the bellows unit 50 with the bellows unit 50 in an upright position as shown in FIG. 3 of the drawings. If a chair position is desired, the user inflates the bellows unit 50 and then pivots the first mattress 20 beneath the second mattress 40 as shown in FIG. 2 of the drawings. Importantly, because the first mattress 20 is larger than the second mattress, when the first mattress is beneath the second mattress, a stable chair structure is provided. When the user desires to store the present invention, a pressure relief valve or similar structure may be opened to release the air pressure within the first mattress 20, the second mattress 40 and the bellows unit 50.

Figure 10:
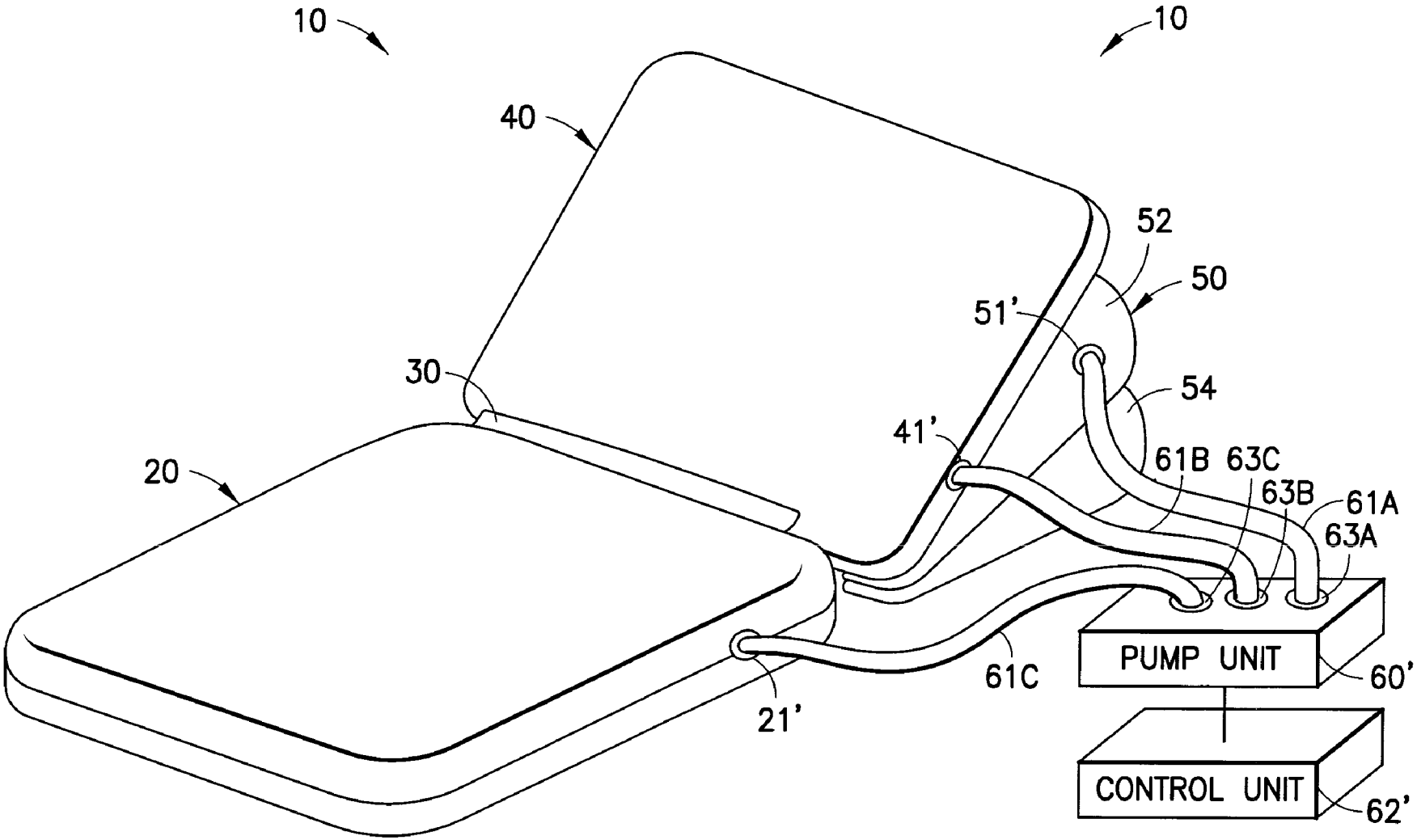
FIG. 10 is an upper perspective view of yet another alternate embodiment of the invention in the adjustable lounge position.
Figure 11:
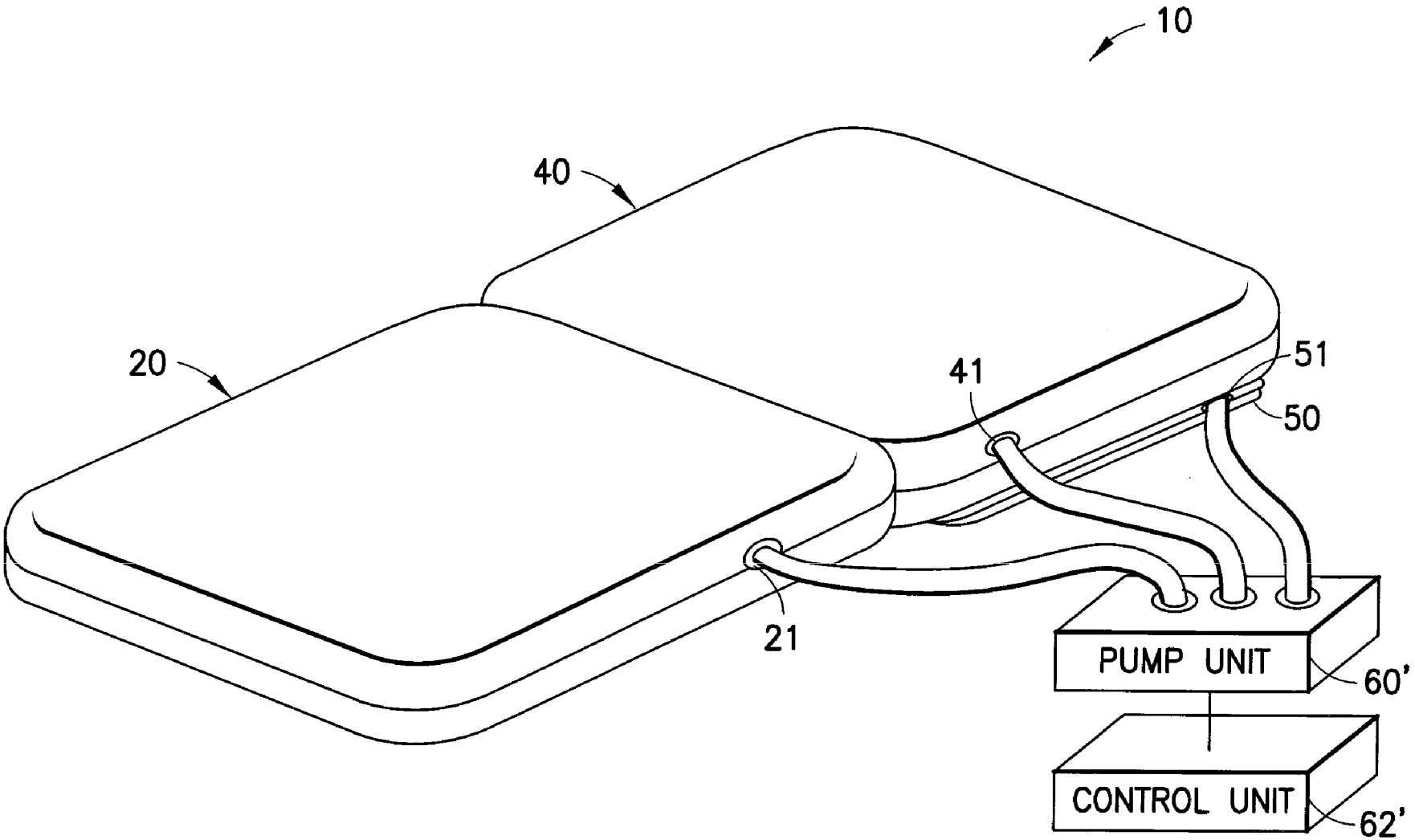
FIG. 11 is an upper perspective view of the alternate embodiment of FIG. 10 in the prone bed position.

In yet another alternative embodiment shown in FIGS. 10 and 11, the valve elements for the first mattress 20, the second mattress 40 and the bellows unit 50 are substituted with (or adapted to include) fluid coupling means 21', 41', 51' (e.g, a valved or non-valved connector) and hoses 61A, 61B, 61C that are in fluid communication with ports 63A, 63B, 63C of the pump unit 60'. Preferably, the hoses 61A, 61B, 61C are non-detachably connected to the fluid coupling means 21', 41', 51' and/or are non-detachably connected to the ports 63A, 63B, 63C of the pump unit 60'. The pump unit 60' may be comprised of any pump structure capable of providing pressurized air at independently controllable pressures to the first mattress 20, the second mattress 40 and the bellows unit 50 via the respective hose and fluid coupling means. A control unit 62' is operably coupled to the pump unit 60', for example by a wired or wireless connection. The user interacts with the control unit 62' to control the operation of the pump unit 60' in supplying independent pressures to the first mattress 20, the second mattress 40 and the bellows unit 50. FIG. 10 shows the air mattress system in the adjustable lounge position with the bellows unit 50 inflated. FIG. 11 shows the air mattress system positioned in the prone bed position with the bellows unit 50 deflated. The air mattress system can readily be configured or reconfigured into the other positions described herein, including the chair position (FIG. 1) and the recessed lounge position (FIG. 3). It is contemplated that the dimensions of the first and second mattresses 20, 40 may be the same or different as described above. Moreover, it is contemplated that the shape and structure of the bellows unit 50 may be changed. For example, the bellows unit may comprise one or more air chambers that realize a wedge-shape structure when inflated. The inclined surface (or profile) of this wedge-shaped structure defines the adjustable inclination angle of the second mattress in the adjustable lounge position of the system as described herein.

While specific sizes, materials, shapes, forms, functions and manners of operation, assembly and use have been provided, it will be recognized by those skilled in the art that they may be varied, and all equivalent structural variations and relationships to those illustrated in the drawings and described in the specification are intended to be encompassed by the present invention. Any headings utilized within the description are for convenience only and have no legal or limiting effect. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of manipulating an air mattress system into a position, said system having a first mattress, a second mattress pivotally attached to said first mattress and a bellows unit attached to said second mattress, said position selected from the following group: a chair position, a recessed lounge position, a prone bed position and an adjustable lounge position, said method comprising the steps of:

(a) identifying a desired position of said air mattress system;

(b) inflating said first mattress and said second mattress;

(c) leaving said bellows unit deflated if said desired position is said prone bed position, and otherwise inflating said bellows unit if said desired position is said chair position, said recessed lounge position or said adjustable lounge position;

(d) having said bellows unit positioned under said second mattress and inflating said bellows unit to cause said second mattress to pivot relative to said first mattress if said desired position is an adjustable lounge position;

(e) having said bellows unit positioned atop said second mattress and inflating said bellows unit if said desired position is a recessed lounge position; and (f) pivoting said first mattress beneath said second mattress with said bellows unit positioned atop said second mattress if said desired position is a chair position.

2. A method of supporting the body of a user on a support surface comprising:

a) providing an air maifress system having a first inflatable member, a second inflatable member pivotally attached to said first inflatable member and a third inflatable member attached to said second inflatable member, wherein position of said air maifress system is adjustable between any one of a plurality of user selected positions including a prone bed position and an adjustable lounge position;

b) positioning said first, second and third inflatable members such that said first and third inflatable members rest on said support surface, said second inflatable member is positioned longitudinally adjacent said first inflatable member, and said second inflatable member rests atop said third inflatable member;

c) inflating said first and second inflatable members; and d) controlling an inflation level of said third inflatable member, wherein said third inflatable member is substantially deflated if said user selected position is said prone bed position, and wherein said third inflatable member is inflated to cause said second inflatable member to pivot relative to said first inflatable member if said user selected position is said adjustable lounge position.

3. The method according to claim 2, wherein:

at least a portion of said third inflatable member is substantially U-shaped when inflated.

4. The method according to claim 3, wherein:

said portion of said third inflatable member that is substantially U-shaped when inflated includes two arm sections disposed opposite one another that contact the support surface in said adjustable lounge position.

5. The method according to claim 3, wherein:

said third inflatable member comprises a plurality of substantially U-shaped chambers that are in fluid communication with one another.

6. The method according to claim 2, wherein:

said first, second and third inflatable members are independently inflatable.

7. The method according to claim 6, further comprising:

providing a pump unit with a plurality of ports corresponds to said first, second and third inflatable members, said pump unit operably coupled to a control unit;

coupling each one of first, second and third inflatable members to corresponding ports of said pump unit; and operating said control unit to independently control inflation levels of said first, second and third inflatable members.

8. The method according to claim 2, wherein:

said third inflatable member includes two arm support sections disposed opposite one another and a back support section extending therebetween, wherein portions of said arm support sections and a portion of said back support section contact the support surface in said adjustable lounge position.

9. A method according to claim 8, wherein:

at least part of said arm support sections that contact the support surface in said adjustable lounge position extend along a lengthwise direction toward the portion of the back support section that contacts the support surface in said adjustable lounge position.

* * * * *